US009711836B1

(12) United States Patent
Vela

(10) Patent No.: US 9,711,836 B1
(45) Date of Patent: Jul. 18, 2017

(54) TUNABLE HIGH ISOLATION CIRCULATOR

(71) Applicant: The United States of America, as represented by the Secretary of the Air Force, Washington, DC (US)

(72) Inventor: Russell Vela, Fairborn, OH (US)

(73) Assignee: The United States of America as requested by the Secretary of the Air Force, Washington, DC (US)

( * ) Notice: Subject to any disclaimer, the term of this patent is extended or adjusted under 35 U.S.C. 154(b) by 0 days.

(21) Appl. No.: 14/927,610

(22) Filed: Oct. 30, 2015

(51) Int. Cl.
*H01P 1/36* (2006.01)
*H01P 1/383* (2006.01)

(52) U.S. Cl.
CPC ..... *H01P 1/383* (2013.01); *H01P 1/36* (2013.01)

(58) Field of Classification Search
CPC ..... H01P 1/32; H01P 1/36; H01P 1/38; H01P 1/383
USPC ..... 333/1.1, 24.2
See application file for complete search history.

(56) References Cited

U.S. PATENT DOCUMENTS 6,067,448 A 5/2000 Ho et al.
6,313,713 B1 11/2001 Ho et al.
6,567,648 B1 5/2003 Ahn et al.
8,077,639 B2 12/2011 Knox
8,111,640 B2 2/2012 Knox
8,515,803 B2 8/2013 Meyer et al.
8,750,173 B2 6/2014 Knox
2012/0182906 A1 7/2012 Knox

OTHER PUBLICATIONS

Lim and Yu, "Balanced Circulator Structure with Enhanced Isolation Characteristics," Microwave and Optical Technology Letters, vol. 50, Issue 9, pp. 2389-2391, Sep. 2008.

*Primary Examiner* — Stephen E Jones
(74) *Attorney, Agent, or Firm* — AFMCLO/JAZ; Jason Sopko

(57) ABSTRACT

A system for improving port isolation of a three port circulator device includes a power splitter having a power splitter input and two power splitter outputs. A first circulator has a first circulator first port, a first circulator second port, and a first circulator third port, and the first circulator first port is electrically coupled to the first of the two power splitter outputs. A second circulator has a second circulator first port, a second circulator second port, and a second circulator third port, and the second circulator first port is electrically coupled to the second of the two power splitter outputs. A first trimmer is electrically coupled to the first circulator third port and a second trimmer is electrically coupled to the second circulator third port. The system further includes a power combiner having two power combiner inputs and one power combiner output, and the first of the two power combiner inputs is electrically coupled to the first trimmer and the second of the two power combiner inputs is electrically coupled to the second trimmer.

9 Claims, 2 Drawing Sheets

TUNABLE HIGH ISOLATION CIRCULATOR

RIGHTS OF THE GOVERNMENT

The invention described herein may be manufactured and used by or for the Government of the United States for all governmental purposes without the payment of any royalty.

FIELD OF THE INVENTION

The present invention relates generally to radio frequency signal processing and, more particularly, to enhanced port isolation in systems using microwave circulators.

BACKGROUND OF THE INVENTION

An RF junction circulator, duplexer, or T/R switch (or, as will be used in the discussion that follows, a "circulator") is a three-port device formed by a symmetrical Y junction coupled to magnetically biased ferrite material. Coaxial based components may utilize substrate material for the conductive path of the signal, and the ferrite element to divert the fields between ports. The circulator permits the flow of microwave energy in one direction only, e.g. from port 1 to 2, 2 to 3, and 3 to 1. When one of the ports is terminated with a load under a matched configuration, the other two are isolated in the reverse direction. Thus, an isolator is a circulator which has a matched termination, usually integral to the unit, on port 3.

In these devices, port 1 would be considered the "input" port, 2 would be the input or output port, depending on the application or mode, and 3 would be the output port. For example, in a traditional radar configuration, port 1 is connected to a transmitter, port 2 to the antenna, and port 3 to the receive architecture. In operation, the transmit pulse would propagate from port 1 to port 2; the received signal from the antenna would then go from port 2 to port 3.

Unfortunately, port 1 and port 3 are not completely isolated from one another, thus contributing to leakage into port 3. This leakage of the transmit signal results in degradation in performance of the overall system, as the minimum detectable received signal should be above the leakage signal. If leakage between ports 1 and 3 is reduced, however, the attenuated noise would allow for a cleaner signal from port 2 to be observed at port 3. By way of example, it would enhance minimum detectable ranges of signals, or targets, in radar applications. Additionally, such noise reduction can enable higher achievable dynamic ranges in microwave receiver architectures. From a communications perspective, this would allow reception of even weaker signals in devices which both transmit and receive simultaneously.

Known methods of attenuating undesired internal reflections are either only moderately effective, or operate in a less effective digital, post-analog-processing, regime. As a result, there exists a need in the art for improved systems and methods to reduce or eliminate leakage signals and undesirable internal reflections in microwave circulators.

SUMMARY OF THE INVENTION

The present invention overcomes the foregoing problems and other shortcomings, drawbacks, and challenges of reducing undesirable reflections and interference in microwave systems. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a system for improving port isolation of a three port circulator device is provided. The system includes a power splitter having a power splitter input and two power splitter outputs. A first circulator has a first circulator first port, a first circulator second port, and a first circulator third port, and the first circulator first port is electrically coupled to the first of the two power splitter outputs. A second circulator has a second circulator first port, a second circulator second port, and a second circulator third port, and the second circulator first port is electrically coupled to the second of the two power splitter outputs. A first trimmer is electrically coupled to the first circulator third port and a second trimmer is electrically coupled to the second circulator third port. The system further includes a power combiner having two power combiner inputs and one power combiner output, and the first of the two power combiner inputs is electrically coupled to the first trimmer and the second of the two power combiner inputs is electrically coupled to the second trimmer.

According to another embodiment of the disclosed invention, in a system including a power splitter having a power splitter input and two power splitter outputs; a first circulator having a first circulator first port, a first circulator second port, and a first circulator third port, wherein the first circulator first port is electrically coupled to the first of the two power splitter outputs; a second circulator having a second circulator first port, a second circulator second port, and a second circulator third port, wherein the second circulator first port is electrically coupled to the second of the two power splitter outputs; a first trimmer electrically coupled to the first circulator third port and a second trimmer electrically coupled to the second circulator third port; and a power combiner having two power combiner inputs and one power combiner output, wherein the first of the two power combiner inputs is electrically coupled to the first trimmer and the second of the two power combiner inputs is electrically coupled to the second trimmer; a method for adjusting the first trimmer and the second trimmer to yield improved port isolation is provided. The method includes terminating a matching impedance fixed load and test load to the first circulator second port and the second circulator second port, respectively. The method further includes terminating test instrumentation at the power combiner output. A desired frequency signal is injected into the input of the power splitter. The strength of the signal at the power combiner output is observed. Either of the first trimmer or the second trimmer is adjusted to yield an attenuated desired frequency signal. The strength of the attenuated desired frequency signal is observed.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following discussion will disclose systems and methods to enhance performance in three port circulator applications. By way of example, the disclosure relates to systems for canceling impedance mismatch reflections from port two of a circulator, in addition to enhancing isolation between ports one and three. Further, the disclosed systems will be directed to cancellation of reflections from port two to port one to port three, as well as optimizing signal purity from port two to port three. Unexpectedly high performance will be demonstrated by comparing the roughly −25 dB isolation values of known circulators with the approximately −70 dB values realized by the disclosed and claimed system.

Figure 1:
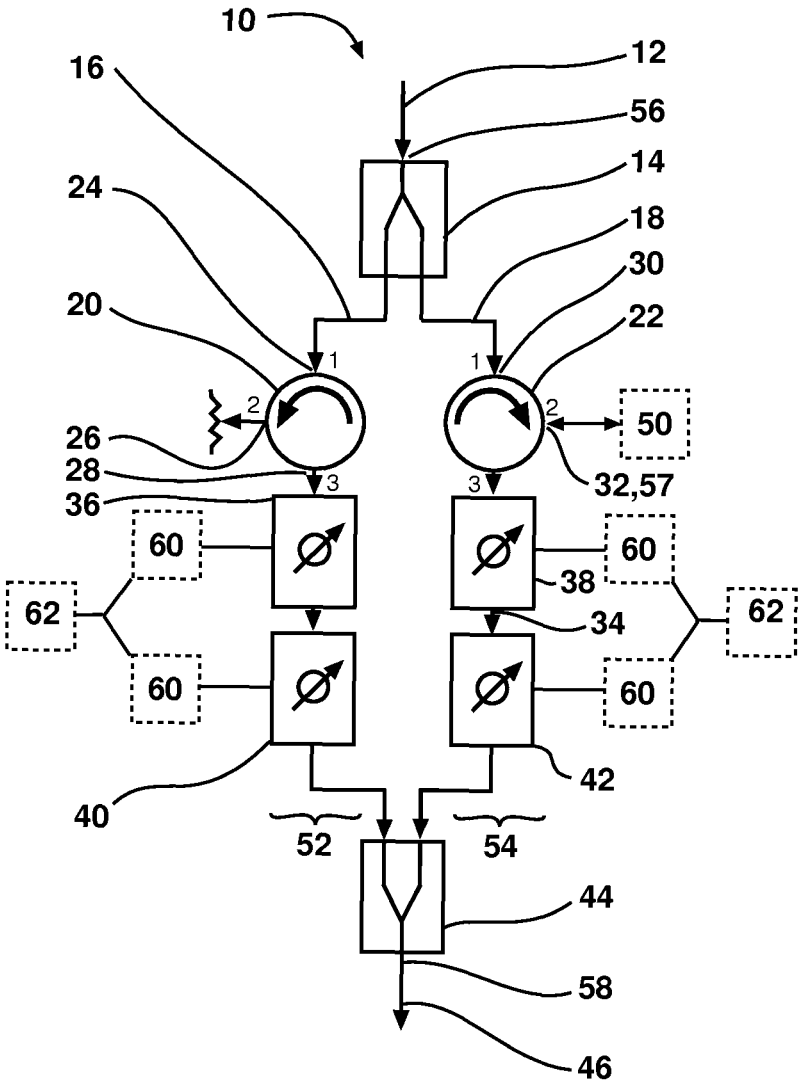
FIG. 1 is a schematic view of a microwave reflection reducing system in accordance with embodiments of the disclosed invention.

Turning attention to FIG. 1, the system 10 receives an input signal 12 and sends it to a power splitter 14. The power splitter 14 divides the input signal 12 into a first path 16 and a second path 18. The input signal 12 of the first path 16 and the second path 18 travel to a quasi-identical first circulator 20 and second circulator 22.

The circulators 20 and 22 are described as quasi-identical because even circulators of the same model and batch will include variability introduced in the manufacturing process. The placement or orientation of internal ferromagnetic materials, tuning performed by the factory technician, variations in materials, etc. will all impact the performance and characteristics of the circulator in a quantifiable way. In the system 10 that follows, enhanced performance will be achieved if circulators 20 and 22 are selected to minimize such variables to the extent possible. Selected circulators 20 and 22 should be of the same model number, same batch, and preferably close in serial number to each other. Further, a plurality of similar serial numbered devices may be profiled on a network analyzer to select a pair of circulators 20 and 22 having the closet performance characteristics. Performance characteristics, include, but are not limited to, voltage standing wave ratio (VSWR), insertion loss, isolation, operational frequency range, impedance, and power handling capability.

First circulator port one 24 and second circulator port one 30 are coupled to the power splitter 14, and first circulator port three 28 and second circulator port three 34 are coupled to a first phase trimmer 36 and second phase trimmer 38, respectively. A third phase trimmer 40 and fourth phase trimmer 42 may be coupled in series to the first phase trimmer 36 and second phase trimmer 38, respectively, to provide enhanced adjustment as will be described below.

The outputs of the first phase trimmer 36 and second phase trimmer 38 (or outputs of the third phase trimmer 40 and fourth phase trimmer 40, if employed), terminate into a power combiner 44. After tuning and configuration (as will be explained in detail below) the system 10 will behave analogous to (with significantly enhanced isolation and reflection reduction) a traditional circulator.

According to embodiments of the disclosed invention, the system 10 may be tuned to center the highest isolation at a desired frequency. During tuning, second terminal port two 32 of the invention may be "loaded" or matched to a similar impedance load at first circulator port two 26 (e.g., if the first circulator second port 26 fixed load is matched to 50Ω then the test load 50 should also be 50Ω). Once the resistor, or test load 50, is attached, the output signal 46 should be connected to a device which allows the operator to observe the frequency response (e.g., spectrum analyzer, network analyzer, etc.). Once connected to suitable monitoring instrumentation, the desired frequency is injected into the power splitter 14 (which in turn is conveyed to first circulator port one 24 and second circulator port one 30). It should be noted that "load" attached to port 26 of circulator 20, influences the performance of the overall invention. As such, to optimize the matching to the load on port 2 of 22, an impedance matching network can also be utilized instead of a fix load. This ability to "tune" the impedance will allow the invention to meet a wider assortment of needs within the community.

As will be recognized by one of ordinary skill in the art, the desired central frequency should be within the operational frequency ranges of each of the components utilized in this system 10 (e.g., circulators 20 and 22, power splitters 14, power combiners 44, phase trimmers 36, 38, 40, and 42, etc.). Acceptable results may be achieved if each of the phase trimmers 36, 38, 40, and 42 are initially adjusted to their minimum values. With the desired signal injected, the phase trimmers 36, 38, 40, and 42 of a single "channel", or leg, of the system 10 (e.g., trimmers 36 and 40 coupled to the first circulator 20 constitute a first channel 52, while trimmers 38 and 42 coupled to second circulator 22 constitute a second channel 54) are adjusted while observing the resultant output signal 46 on the spectrum analyzer or network analyzer.

Once the frequency of a channel 52 or 54 is sufficiently offset in phase, it will begin to destruct the opposing channel's signal. One should continue to adjust the phase trimmers 36, 38, 40, and 42, until the desired frequency of interest has reached its minimum value. Note that this technique can also be performed for wide bandwidth, and ultra wide bandwidth signals as well. In ultra wide bandwidth configurations, two regions will develop: a high isolation region (in some instances approaching 70 dB) with limited bandwidth, and larger bandwidth region of less, but still high isolation (in some instances approaching 50 dB).

While the above describes the general method for tuning the invention, the overall method can be automated, or computer controlled to ensure reproducibility. Microcontrollers, Field Programmable Gate Arrays (FPGAs), or Digital Signal Processors (DSPs), can be programmed to step through a series of routines which would control both the tuning of the phases shifters, as well as monitoring the frequency spectrum of 46. This realtime feedback loop would provide an optimal method for production. Note that during this process, as the devices are analog in nature, digitization of the signal on 46 should utilize a high sampling rate analog to digital converter (ADC) as the precision of the digitizer would determine the precision, or depth, of the signal cancellation, and therefore spectral null.

Once maximum attenuation of the desired signal has been achieved on the spectrum analyzer, oscilloscope, or network analyzer, the internal reflections, and leakage between the two signal paths has been minimized. The load 50 is then removed from second circulator port two 32. Once tuning is complete, the disclosed system 10 is ready to serve as a high isolation circulator, having a systemic port one 56 input, a systemic port two 57 output/input, and a systemic port three 58 output.

In some embodiments of the disclosed invention, the trimmers may be configured to allow manipulation by a cooperating servo, linear actuator, or the like (a trimmer tuner 60). In some embodiments, the trimmer tuner 60 may be coupled to a rotary adjustable trimmer, while in other embodiments, sliding type trimmers may be coupled to an external adjustment mechanism. Phase trimmer examples vary, and include, but are not limited to, surface mount variations, connectorized and pre-packaged modules, in both digital and analog instantiations. Phase shifters, or trimmers, can also be derived by variable delay line techniques and are readily found in COTS such as those in the Data Delay Device's 1500 series, ELMEC Technology's VDA series, or the ADSANTEC ASNT series.

A controller 62 having a processor and memory, may be coupled to the trimmer tuners 60. The controller 62 may be configured to generate and inject an appropriate input signal 12, observe the resultant output signal 46, and iteratively adjust each of the trimmers 36, 38, 40, and 42 until maximum attenuation of the desired frequency is achieved. In some embodiments, the controller 62 is configured to adjust the trimmers 36, 38, 40, and 42 until a minimum attenuation is achieved (e.g., at least −50 dB). In other embodiments, the controller 62 is configured to halt tuning and accept a sub-optimal attenuation after a selected period of time, a selected number of iterations, or upon exceeding other thresholds.

In further embodiments, the tuning is performed for a plurality of desired input signal 12 frequencies, and the acceptable tuning values are retained for each of the plurality of desired frequencies. For example, the controller 62 may perform tuning for each of 2 GHz, 10 GHz and 18 GHz. The tuning values, or relative positions of the trimmers 36, 38, 40, and 42, are retained by the controller 62 for future use. In some embodiments of the disclosed invention, the controller 62 may select appropriate tuning value for additional frequencies by interpolation or other approximation techniques. As a result, the system 10 can be reconfigured on the fly, in near-real time by the controller 62, to be optimized for each of 2, 10, and 18 GHz.

It should be noted that the individual specifications of the components utilized in this system 10 yield the overall frequency and power boundaries. Design considerations will dictate the selected devices for the system 10 to ensure that the desired frequency, power, bandwidth, and insertion losses are achieved.

A note on the insertion loss of the device is also important to mention. In the configuration disclosed above, the highest individual component insertion loss is provided by the first power splitter 14 at systemic port one 56. Low loss components should be selected to ensure that minimum insertion loss between systemic port one 56 and systemic port two 57 is achieved.

Figure 2:
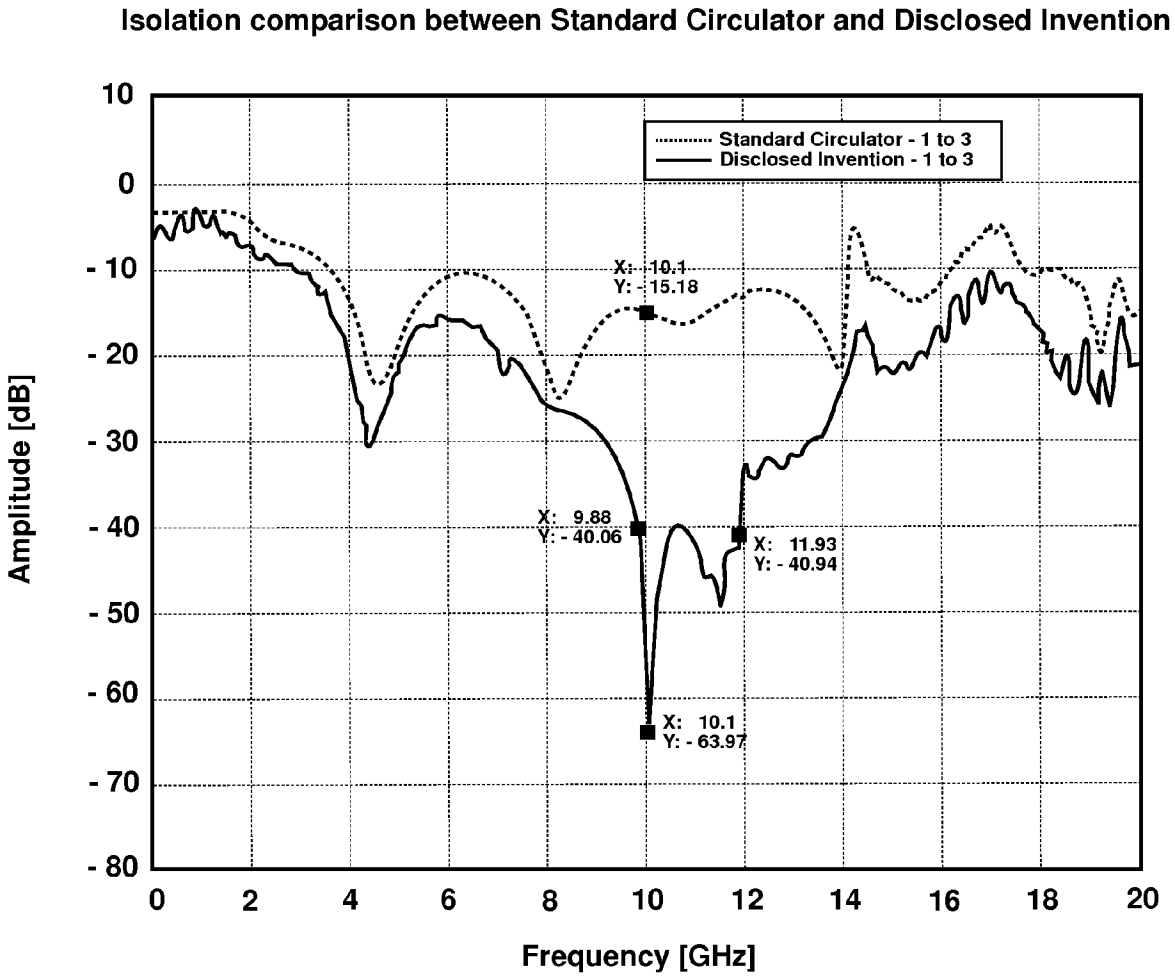
FIG. 2 is a graph demonstrating the enhanced reflection isolation of the disclosed system as compared to a traditional circulator.

In use, significant isolation and reflection cancellation may be achieved by embodiments of the disclosed invention. Turning attention to FIG. 2, embodiments of the disclosed invention yield unexpected circulator performance improvements across ultra wideband frequencies, and greater isolation at narrower bandwidths. The resultant graph was captured from an actual laboratory configuration. For purposes of comparison, the dotted graph represents the isolation performance of a standard circulator (best performance of approximately −25 dB). While the disclosed invention yielded an attenuation of −63 dB, attenuation approaching −70 dB has been observed by further refinement of the trimmer adjustments. It is further noted that improved attenuation of approximately −40 dB are shown over the bandwidth of approximately 10 to 12 GHz.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A system for improving port isolation of a three port circulator device, the system comprising:

a power splitter having a power splitter input and two power splitter outputs;

a first circulator having a first circulator first port, a first circulator second port, and a first circulator third port, wherein the first circulator first port is electrically coupled to the first of the two power splitter outputs;

a second circulator having a second circulator first port, a second circulator second port, and a second circulator third port, wherein the second circulator first port is electrically coupled to the second of the two power splitter outputs;

a first trimmer electrically coupled to the first circulator third port and a second trimmer electrically coupled to the second circulator third port;

a power combiner having two power combiner inputs and one power combiner output, wherein the first of the two power combiner inputs is electrically coupled to the first trimmer and the second of the two power combiner inputs is electrically coupled to the second trimmer; and a third trimmer disposed between the first trimmer and the power combiner.

2. A system for improving port isolation of a three port circulator device, the system comprising:

a power splitter having a power splitter input and two power splitter outputs;

a first circulator having a first circulator first port, a first circulator second port, and a first circulator third port, wherein the first circulator first port is electrically coupled to the first of the two power splitter outputs;

a second circulator having a second circulator first port, a second circulator second port, and a second circulator third port, wherein the second circulator first port is electrically coupled to the second of the two power splitter outputs;

a first trimmer electrically coupled to the first circulator third port and a second trimmer electrically coupled to the second circulator third port;

a power combiner having two power combiner inputs and one power combiner output, wherein the first of the two power combiner inputs is electrically coupled to the first trimmer and the second of the two power combiner inputs is electrically coupled to the second trimmer; and a third trimmer disposed between the second trimmer and the power combiner.

3. A system for improving port isolation of a three port circulator device, the system comprising:

a power splitter having a power splitter input and two power splitter outputs; a first circulator having a first circulator first port, a first circulator second port, and a first circulator third port, wherein the first circulator first port is electrically coupled to the first of the two power splitter outputs;

a second circulator having a second circulator first port, a second circulator second port, and a second circulator third port, wherein the second circulator first port is electrically coupled to the second of the two power splitter outputs;

a first trimmer electrically coupled to the first circulator third port and a second trimmer electrically coupled to the second circulator third port;

a power combiner having two power combiner inputs and one power combiner output, wherein the first of the two power combiner inputs is electrically coupled to the first trimmer and the second of the two power combiner inputs is electrically coupled to the second trimmer;

a fixed load electrically coupled to the first circulator second port;

further including a test load coupled to the second circulator second port, wherein the impedance of the test load is approximately equal to the impedance of the fixed load.

4. In a system including a power splitter having a power splitter input and two power splitter outputs; a first circulator having a first circulator first port, a first circulator second port, and a first circulator third port, wherein the first circulator first port is electrically coupled to the first of the two power splitter outputs; a second circulator having a second circulator first port, a second circulator second port, and a second circulator third port, wherein the second circulator first port is electrically coupled to the second of the two power splitter outputs; a first trimmer electrically coupled to the first circulator third port and a second trimmer electrically coupled to the second circulator third port; and a power combiner having two power combiner inputs and one power combiner output, wherein the first of the two power combiner inputs is electrically coupled to the first trimmer and the second of the two power combiner inputs is electrically coupled to the second trimmer;

a method for adjusting the first trimmer and the second trimmer to yield improved port isolation, the method comprising:

terminating a matching impedance fixed load and test load to the first circulator second port and the second circulator second port, respectively;

terminating test instrumentation at the power combiner output;

injecting a desired frequency signal into the input of the power splitter;

observing the strength of the signal at the power combiner output;

adjusting either of the first trimmer or the second trimmer to yield an attenuated desired frequency signal;

observing the strength of the attenuated desired frequency signal.

5. The method of claim 4, wherein the adjusting is discontinued upon attenuating the desired frequency signal to −25 dB or less.

6. The method of claim 4, wherein the adjusting is discontinued upon attenuating the desired frequency to −65 dB or less.

7. The method of claim 4 further including the steps of proving a trimmer tuner coupled to each of the first and second trimmers; proving a controller having a processor and a memory; wherein the processor is configured to inject the desired frequency, observe the strength of the strength of the attenuated desired frequency signal, and further adjust the trimmer tuners until a specified criterion is achieved.

8. The method of claim 7, wherein the criterion is an attenuation threshold.

9. The method of claim 7, wherein the criterion is an elapsed time.

* * * * *